US005142863A

United States Patent [19]

Ushio et al.

[11] Patent Number: 5,142,863

[45] Date of Patent: Sep. 1, 1992

[54] ENGINE PART PROVIDED WITH MANIFOLD TYPE EXHAUST PASSAGE

[75] Inventors: Hideaki Ushio; Seiji Nishimoto; Koji Tamenori, all of Saitama, Japan

[73] Assignee: Honda Giken Kogyo Kabushiki Kaisha, Tokyo, Japan

[21] Appl. No.: 525,921

[22] Filed: May 17, 1990

[30] Foreign Application Priority Data

May 18, 1989 [JP] Japan ..... 1-57475[U]
Jun. 16, 1989 [JP] Japan ..... 1-70945[U]

[51] Int. Cl.[5] ..... F01N 7/18

[52] U.S. Cl. ..... 60/272; 29/890.08; 60/323; 164/98

[58] Field of Search ..... 60/272, 282, 323; 29/890, 890.08; 64/98

[56] References Cited

U.S. PATENT DOCUMENTS 4,715,799 12/1987 Eiermann ..... 164/98
4,840,154 6/1989 Fingerle ..... 60/282
4,972,674 11/1990 Yamada ..... 60/272

FOREIGN PATENT DOCUMENTS 0285312 10/1988 European Pat. Off. .
3346394 7/1985 Fed. Rep. of Germany .

*Primary Examiner*—Douglas Hart
*Attorney, Agent, or Firm*—Lyon & Lyon

[57] ABSTRACT

An engine part with a cast main body and a manifold type ceramic liner which is cast in the main body to define a manifold type exhaust passage therein, the ceramic liner including a hollow cylindrical liner body and a plurality of cylinder members branched from the liner body, a through portion being provided at a branched area of the ceramic liner for communicating inside and outside of the ceramic liner at which area adjacent cylinder members are branched apart, the through portion being filled with a molten metal at the time of casting the main body.

18 Claims, 18 Drawing Sheets

ENGINE PART PROVIDED WITH MANIFOLD TYPE EXHAUST PASSAGE

BACKGROUND OF THE INVENTION

1. Field of the Invention

The field of the present invention is improvements in engine parts provided with manifold type exhaust passages and more particularly is improvements in such engine parts as comprising a cast main body and a manifold type ceramic liner cast within the main body to define a manifold type exhaust passage, the ceramic liner including a hollow cylindrical liner body and a plurality of cylinder members branched from the liner body.

2. Description of the Prior Art

As engine parts of the mentioned type, there has conventionally been known one disclosed in Japanese Patent Application Laid-open No. 111985/1984, for example.

An engine part having a ceramic liner of the mentioned type used therein tends to be heated excessively during engine operation due to an exhaust gas of a high temperature passing through the cylinder members, at a branched area of the ceramic liner where adjacent cylinder members are branched apart. It is preferable to reduce the radius of the inside surface of the branched area to a possible extent in case the high temperature exhaust gas within the cylinder members should be guided smoothly toward the liner body. This is difficult in the aspect of molding and therefore there remains a demerit that an exhaust gas of a high temperature is liable to stay on the inner surface side of the branched area.

As a result, thermal stress is concentrated on the branched area and this leads to a problem that cracks tend to occur at the branched area since conventional engine parts have not been equipped with specific means for moderating or reducing concentration of such thermal stress.

There is also a problem that the flowing property of molten metal at the time of casting the main body is not good at the branched area since the molten metal is cooled by the ceramic liner and a core member.

SUMMARY OF THE INVENTION

It is, therefore, an object of the present invention to provide an engine part of the mentioned type which is advantageous in that concentration of thermal stress on the branched area of the ceramic liner is moderated and generation of cracks at the branched area is avoided.

It is another object of the invention to provide an engine part of the type described which advantageously permits the flowing property of molten metal around the branched area when casting the main body to be improved and therefore serves to enhance the adherence between the cast main body and the ceramic liner.

In order to achieve the afore-mentioned objects, according to the invention, there is proposed an engine part provided with a manifold type exhaust passage, comprising a cast main body and a manifold type ceramic liner which is cast in the main body and defines a manifold type exhaust passage, the ceramic liner including a hollow cylindrical liner body and a plurality of cylinder members branched from said liner body, wherein a through portion is provided at a branched area of said ceramic liner for providing communication between inside and outside of the ceramic liner at which area adjacent cylinder members are branched apart, said through portion being filled with a molten metal at the time of casting said main body.

With the above arrangement, a projecting portion which is formed continuous with the main body and fills the through portion serves as a heat transfer passage during engine operation and permits the heat around the branched area to be released through the passage toward the main body. Thereby, excessive heating of the branched area is prevented and concentration of thermal stress is moderated. In consequence, generation of cracks at the branched area can be avoided.

On the other hand, at the time of casting the main body, the molten metal filled in the through portion exhibits a heat insulating action to improve the flowing property of melt around the branched area of the ceramic liner. Adherence between the main body and the ceramic liner is enhanced thereby.

Further, according to a feature of the invention, there is proposed an engine part provided with a manifold type exhaust passage wherein a guide portion which is formed integrally with the main body is projected inside of the ceramic liner through the through portion so as to guide the exhaust gas which has passed the adjacent cylinder members toward the liner body.

Owing to this arrangement, the guide portion formed on the main body serves also as a heat transfer passage during engine operation like the foregoing arrangement, heat generated at the branched area is released to the main body through the passage and moreover the exahust gas of a high temperature which has passed the cylinder members is guided smoothly by the guide portion toward the liner body. Accordingly, excessive heating of the branched area is prevented and thermal stress concentration is moderated. Simultaneously the discharge resistence of the exhaust gas is reduced.

In addition, at the time of casting the main body, the molten metal which fills the through portion can also exhibit a heat insulating action.

Furthermore, according to the invention, there is proposed an engine part provided with a manifold type exhaust passage, comprising a cast main body and a bifurcated ceramic liner which is cast in the main body and defines a bifurcated exhaust passage, the ceramic liner including a hollow cylindrical liner body and a pair of cylinder members branched from the liner body, wherein a through portion is provided at a branched area of said ceramic liner for providing communication between inside and outside of the ceramic liner at which area the cylinder members are branched apart, said through portion being filled with a molten metal at the time of casting said main body, and wherein said hollow cylindrical liner body includes a cylindrical part of an elliptical cross section having an outlet for the exhaust passage, a ratio between a length (L) of the liner body measured on a dividing plane which includes a long diameter of the elliptical cylindrical part and divides the ceramic liner substantailly into two equal parts along the exhaust passage and a length (l) of the cylindrical part being set as follows:

$$0.8 \geqq l/L \geqq 0.25$$

The above arrangement provides such advantages that the solidification and shrinkage force generated at the time of casting the main body is carried on the cylindrical part of an elliptical cross section to prevent occurrence of cracks at the branched wall and that the exhaust gas which has passed the cylinder members can be flown into the liner body smoothly.

However, when the ratio of the two lengths $l/L>0.8$, the radius of the branched wall as measured on the dividing plane becomes large to hinder a smooth flow of the exhaust gas toward the liner body whereas when the ratio $l/L<0.25$, the length l of the cylindrical part is short so that the cylindrical part cannot support the solidification and shrinkage force caused at the time of casting the main body permitting cracks to be generated easily at the branched wall.

Moreover, according to the invention, there is proposed an engine part provided with a manifold type exhaust passage, comprising a cast main body and a bifurcated ceramic liner which is cast in the main body and defines a bifurcated exhaust passage, the ceramic liner including a hollow cylindrical liner body and a pair of cylinder members branched from the liner body, wherein the ceramic liner is formed of alumina-titanate and wherein said hollow cylindrical liner body includes a cylindrical part of an elliptical cross section having an outlet for the exhaust passage, a ratio between a length (L) of the liner body measured on a dividing plane which includes a long diameter of the elliptical cylindrical part and divides the ceramic liner substantially into two equal parts along the exhaust passage and a length (l) of the cylindrical part being set as follows:

$$0.8 \geqq l/L \geqq 0.25$$

With the above arrangement, the flow of exhaust gas is smooth and an engine part obtained has a ceramic liner which is free of any defects and suffers from no cracks at the branched wall thereof.

The above and other objects, features and advantages of the invention will be apparent from reading of the following detailed description of preferred embodiments in conjunction with the accompanying drawings.

BRIEF DESCRIPTION OF THE DRAWINGS

In the accompanying drawings, FIGS. 1-9 show a first group of embodiments wherein FIG. 1 is a longitudinally sectioned, front view of a cylinder head according to an embodiment, corresponding to a sectional view taken along a line I—I of FIG. 2, FIG. 2 is a view taken along a line II—II of FIG. 1, FIG. 3 is a perspective view of a ceramic liner, FIG. 4 is a plan view of the ceramic liner, FIG. 5 is a sectional view taken along a line V—V of FIG. 4, FIG. 6 is an enlarged view of that portion of FIG. 5 as indicated by an arrow VI after casting, FIG. 7 is an enlarged view of that portion of FIG. 6 as indicated by an arrow VII, and FIGS. 8 and 9 are perspective views of other two examples of ceramic liner.

FIGS. 10-19 show a second group of embodiments wherein FIG. 10 is a longitudinally sectioned view of a cylinder head according to an embodiment, which corresponds to a sectional view taken along a line X—X of FIG. 11, FIG. 12 is a sectional view taken along a line XII—XII of FIG. 10, FIG. 13 is an enlarged view of that portion of FIG. 12 as indicated by an arrow XIII, FIG. 14 is a perspective view of the ceramic liner, FIG. 15 is a plan view of the ceramic liner, FIG. 16 is a sectional view taken along a line XVI—XVI of FIG. 15, FIG. 17 is a sectional view taken along a line XVII—XVII of FIG. 16, FIG. 18 is an enlarged view of that portion of FIG. 17 as indicated by an arrow XVIII, and FIG. 19 is a plan view of another example of ceramic liner.

FIGS. 20-23 show a modified form of ceramic liner wherein FIG. 20 is a plan view, FIG. 21 is a sectional view taken along a line XXI—XXI of FIG. 20, FIG. 22 is an end view seen in a direction of arrow XXII of FIG. 21, and FIG. 23 is an end view sectioned along a line XXIII—XXIII of FIG. 21.

FIGS. 24 and 25 show a modified form of ceramic liner wherein FIG. 24 is a perspective view and FIG. 25 is a plan view.

FIGS. 27 and 27A show a further modified form of ceramic liner wherein FIG. 27 is a sectional view and FIG. 27A is an enlarged view of that portion of FIG. 27 as shown by an arrow XXVIIa.

DESCRIPTION OF PREFERRED EMBODIMENTS

FIGS. 1-9 show a first group of embodiments.

Figure 1:
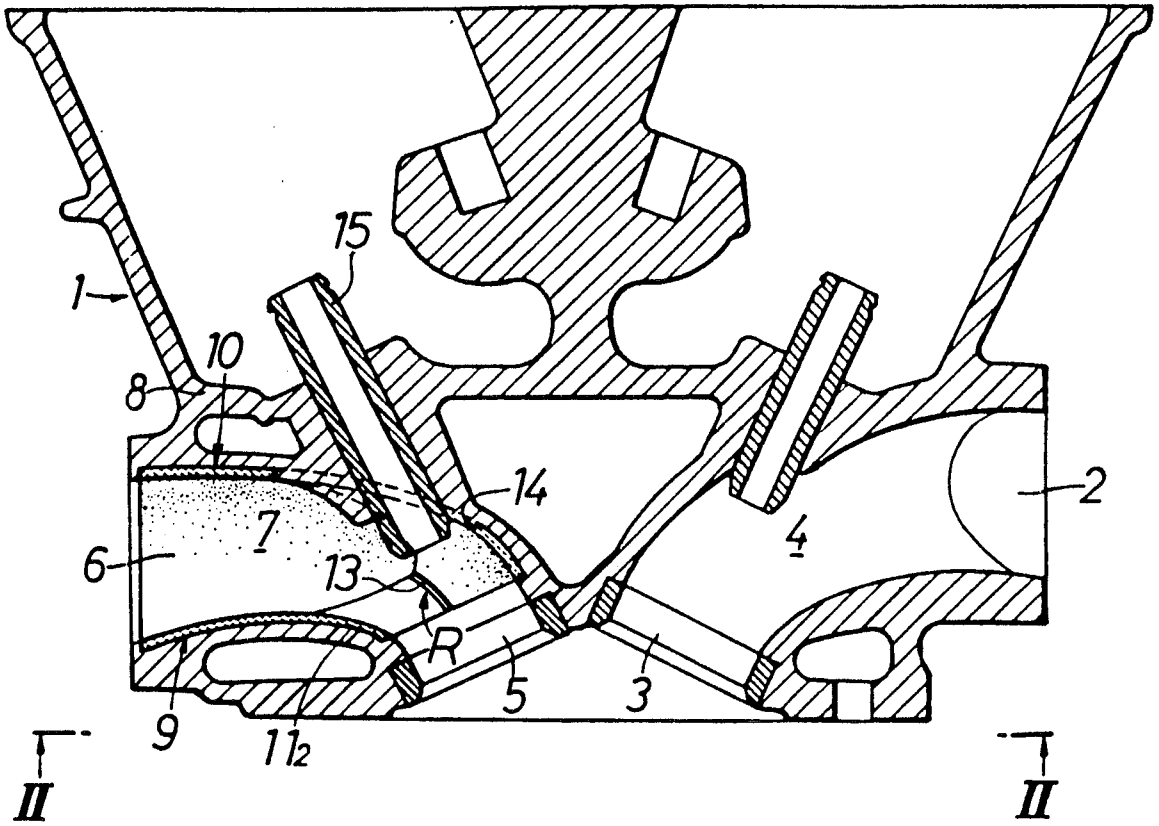
Figure 2:
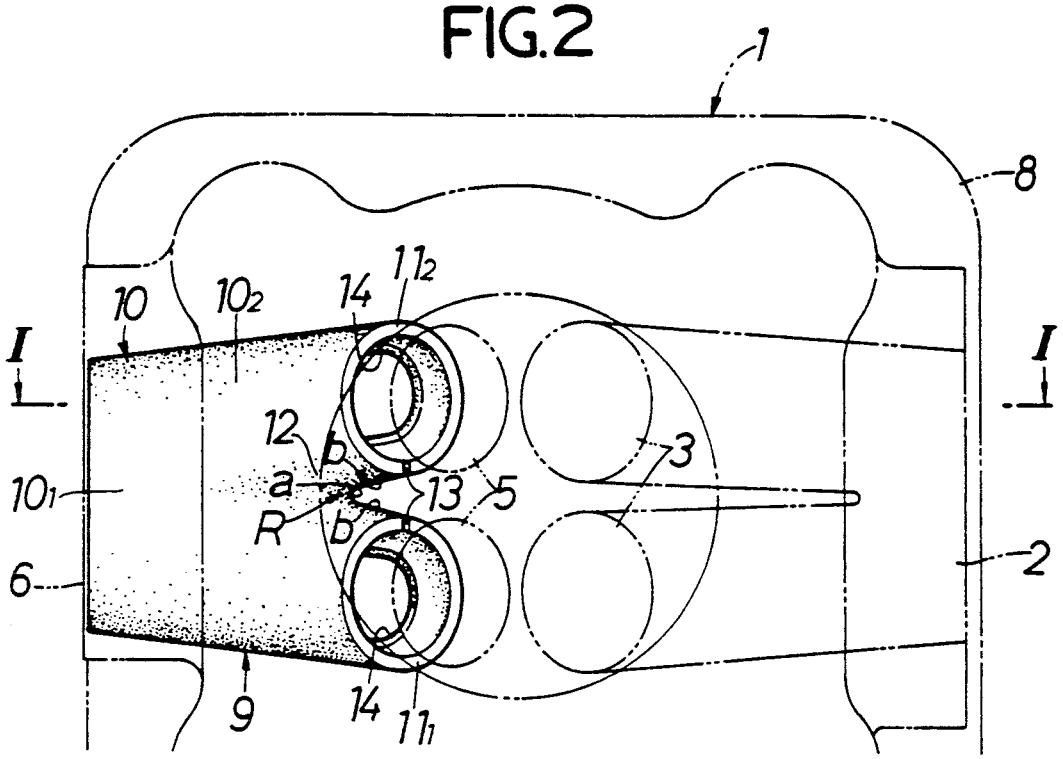
Figure 3:
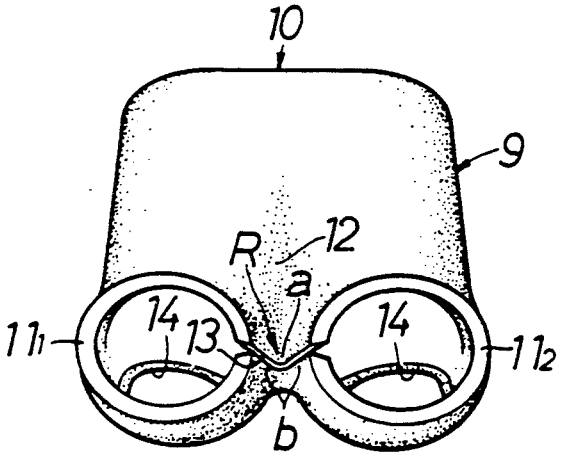
Figure 4:
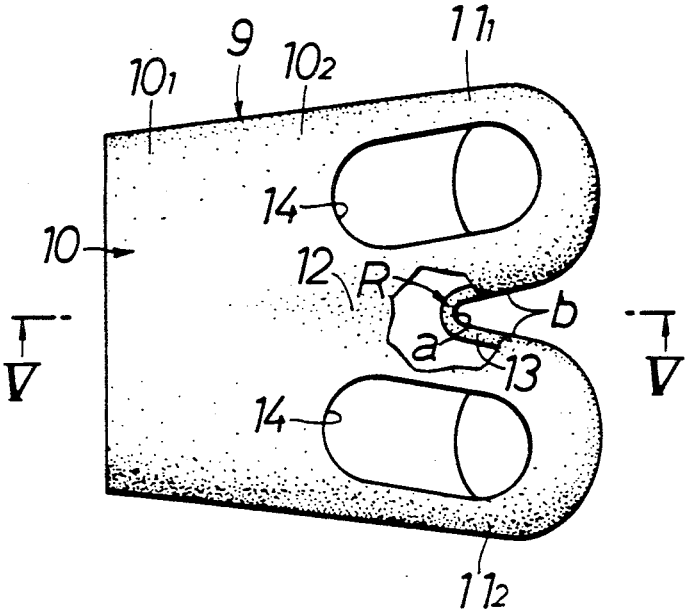

In FIGS. 1 and 2, a cylinder head 1 for an engine is shown as an engine part according to one embodiment of the invention and it is provided with a manifold type intake passage which is in the illustration a bifurcated intake passage 4 having one inlet 2 and two outlets 3, and a manifold type exhaust passage which is in the illustration a bifurcated exhaust passage 7 having two inlets 5 and one outlet 6. The cylinder head 1 comprises a cylinder head body 8 made of aluminum alloy as a cast main body and a manifold type (bifurcated in the illustration) ceramic liner 9 which is cast within the main body 8 and defines the exhaust passage 7 therein.

In FIGS. 2 to 5, the ceramic liner 9 is formed by using alumina-titanate ($Al_2O_3.TiO_3$) as a ceramic material. Alumina-titanate has a relatively small rupture stress $\sigma_B$ based on three-point bending test and a relatively low Young's modulus. It further has a small coefficient of thermal expansion and a small thermal conductivity and is superior in thermal shock resistance. Alumina-titanate is a material most suitable for forming this kind of ceramic liner 9.

The ceramic liner 9 includes a hollow cylindrical liner body 10 and a plurality of cylinder members branched from the liner body 10, in the illustration a pair of first and second cylinder members $\mathbf{11_1}$ and $\mathbf{11_2}$.

Figure 5:
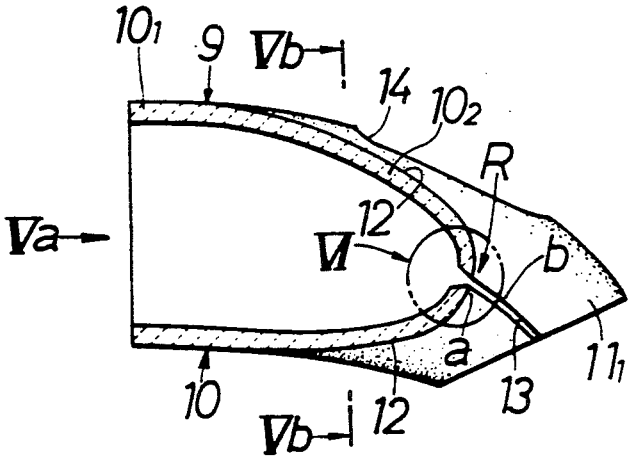
Figure 5A:
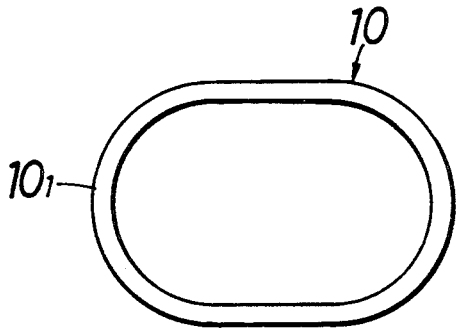
FIG. 5A is an end view seen in a direction of arrow Va of FIG. 5.
Figure 5B:
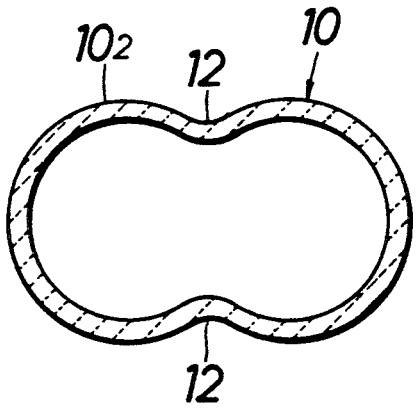
FIG. 5B is an end view sectioned along a line Vb—Vb of FIG. 5.

As is clearly shown in FIGS. 5, 5A and 5B, the liner body 10 comprises a first cylindrical part $\mathbf{10_1}$ having the outlet 6 for the exhaust passage 7 and a second cylindrical part $\mathbf{10_2}$ located between the first cylindrical part $\mathbf{10_2}$ and the pair of cylinder members $\mathbf{11_1}$, $\mathbf{11_2}$. As shown in FIG. 5A, the first cylindrical part 101 has a substantially track-shaped cross section formed by a pair of parallel, mutually opposed straight portions and a pair of mutually opposed curved portions. As shown in FIG. 5B, the second cylindrical part $\mathbf{10_2}$ has a pair of recess portions 12 which extend from the central portions of parallel, opposed walls of the first cylindrical part $\mathbf{10_1}$ toward a branched wall a disposed between both the cylinder members $\mathbf{11_1}$ and $\mathbf{11_2}$ while increasing their depth gradually.

A slit 13 is formed so as to extend continuously over a branched area R on the ceramic liner 9 at which area the adjacent first and second cylinder members $11_1$ and $11_2$ are branched apart, and more specifically in the illustrated embodiment over the branched wall a of the liner body 10 and opposed portions b of the peripheral walls of both the cylinder members $11_1$ and $11_2$. This slit 13 penetrates through the branched wall a and the opposed portions b of the peripheral walls to provide communication between inside and outside of the liner 9. Reference numeral 14 denotes a through hole for receiving therethrough a valve guide 15.

Figure 6:
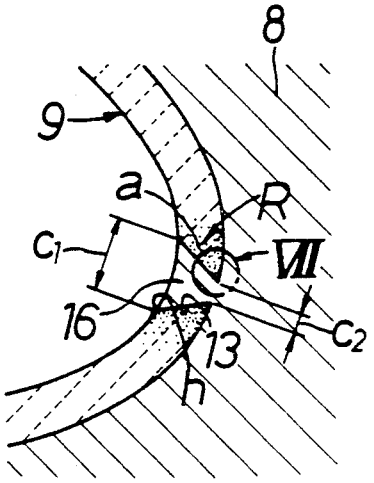

As is apparent from FIG. 6, the slit 13 is designed such that its opening on the inner side of the ceramic liner 9 has a width $c_1$ set larger than a width $c_2$ of its opening on the outer side of the ceramic liner 9, whereby the slit 13 has a cross section of dovetail groove shape.

Figure 7:
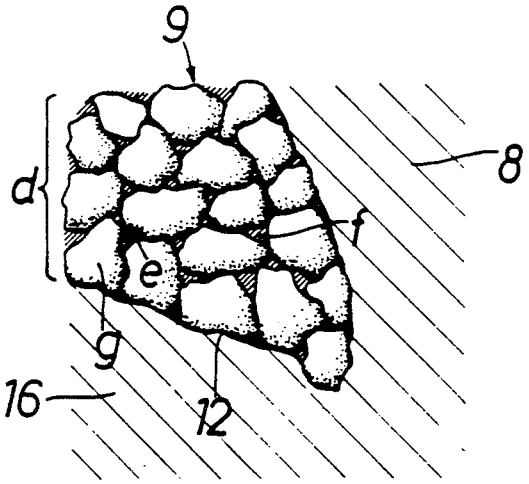

As is clearly shown in FIG. 7, glass f is filled into spaces e such as holes and cracks present in the inner wall d of the slit 13. In this Figure, reference character denotes particles of alumina-titanate.

As the glass f, at least one selected from silicate glass, borate glass and phosphate glass is used.

When filling the spaces e with the glass f, a fluid of dispersion of glass particles is coated to a ceramic molded article made of alumina-titanate and is then permitted to be impregnated into the spaces e by capillary action. Thereafter, the glass f is melted down in the process of sintering the ceramic molded article. It is useful to add alumina-titanate to the fluid of dispersion as a formulation ingredient for the reinforcement purpose and when added with alumina-titanate, the fluid of dispersion may be in a state of slurry.

One example of the conditions for manufacturing the ceramic liner 9 will be described as follows: the diameter of alumina-titanate particles 0.1–10 μm; the method of molding . . . slip casting; glass particles used in the fluid of dispersion . . . silicate glass particles of a diameter not more than 1 μm, at a load of 20 weight % and in water as dispersion medium; sintering is conducted for five hours at a temperature of 1500° C. after coating of the fluid of dispersion.

It is also possible, in filling the spaces e with the glass f, to carry out coating and impregnation treatments after sintering and then a heating treatment, or to conduct first and second sintering treatments wherein a provisionally sintered ceramic article which corresponds to the ceramic liner 9 and which has been subjected to the first sintering treatment at a temperature of 300° to 1400° C. for 0.5 hours is coated and impregnated with the fluid of dispersion and thereafter is subjected to the second sintering treatment.

In this case, when the coating treatment is conducted after sintering, the heating treatment is carried out at a temperature of 1100°–1400° C. for 1–5 hours in the atmosphere and the conditions of the second sintering treatment are the same as of the afore-mentioned sintering treatment of alumina-titanate (1500°–1600° C., 3–10 hours).

One example of the casting conditions for the cylinder head body 8 in which the ceramic liner 9 is sued will be as follows: the ceramic liner 9 is preheated at a temperature of 150° C.; molten aluminum alloy (JIS AC2B) is at a temperature of 750° C. and is poured under pressure of 0.25 kg/cm$^2$; and the low pressure casting method is applied.

Through the afore-mentioned casting operation, the ceramic liner 9 is cast in the cylinder head body 8 and the molten metal is charged into the slit 13 as clearly shown in FIG. 6. Since the molten metal charged in the slit 13 can provide a heat insulating action, the flowing property of the molten metal around the branched area R of the ceramic liner 9 is good and the adherance between the cylinder head body 8 and the ceramic liner 9 is improved. Moreover, since the opening edge portion h of the slit 13 on the inner side of the ceramic liner 9 forms an obtuse angle, any compression stress acting on the ceramic liner 9 during solidification of the molten metal cannot produce cracks at the opening edge portion h.

With the arrangement described above, a ridge 16 which is formed as a projecting portion continuous with the cylinder head body 8 and fills the slit 13 serves as a heat transfer passage during engine operation to permit heat at the branched area R to be released to the cylinder head body 8 through the heat transfer passage whereby the branched area R is prevented from being heated excessively and concentration of the thermal stress thereon is moderated. Owing to this, occurrence of cracks at the branched area R is prevented.

The ridge 16 is molded to have a dovetail cross-section and hence provides an anchoring effect which enables the cylinder head body 8 and the ceramic liner 9 to be adhered to each other in a preferable manner.

In addition, slides may be caused between the slit 13 and the ridge 16 during engine operation due to differences in coefficients of thermal expansion and thermal shrinkage between the aluminum alloy and the ceramic material. According to this embodiment, however, the glass f has been filled in the spaces e present in the inner wall d of the slit 13 as has been mentioned above for reinforcement of the wall d and this reinforcing action works to prevent the inner wall d from being damaged due to such slides.

When a ceramic liner is not formed with the afore-mentioned slit 13, cracks resulting from compression stress caused by solidification and shrinkage of the molten metal may be generated on that inside surface portion of the branched wall a which corresponds to the slit 13 due to a small radius of the arcuate wall a. Provision of the slit 13, however, serves advantageously to eliminate occurrence of such cracks.

Figure 8:
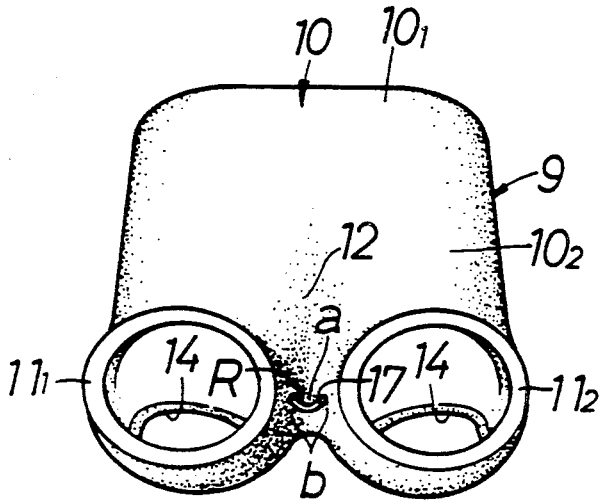
Figure 9:
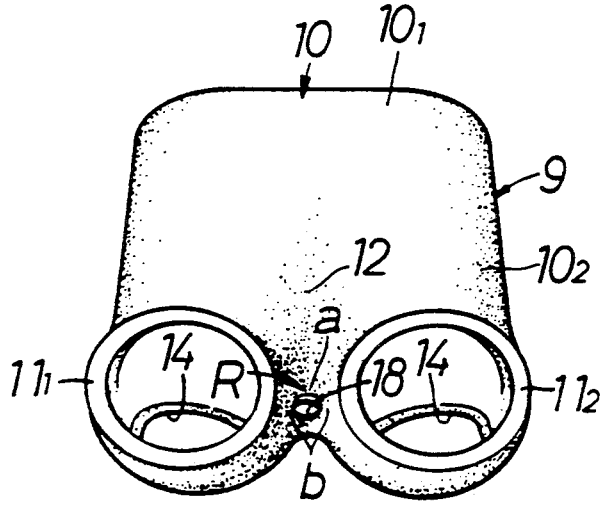
Figure 10:
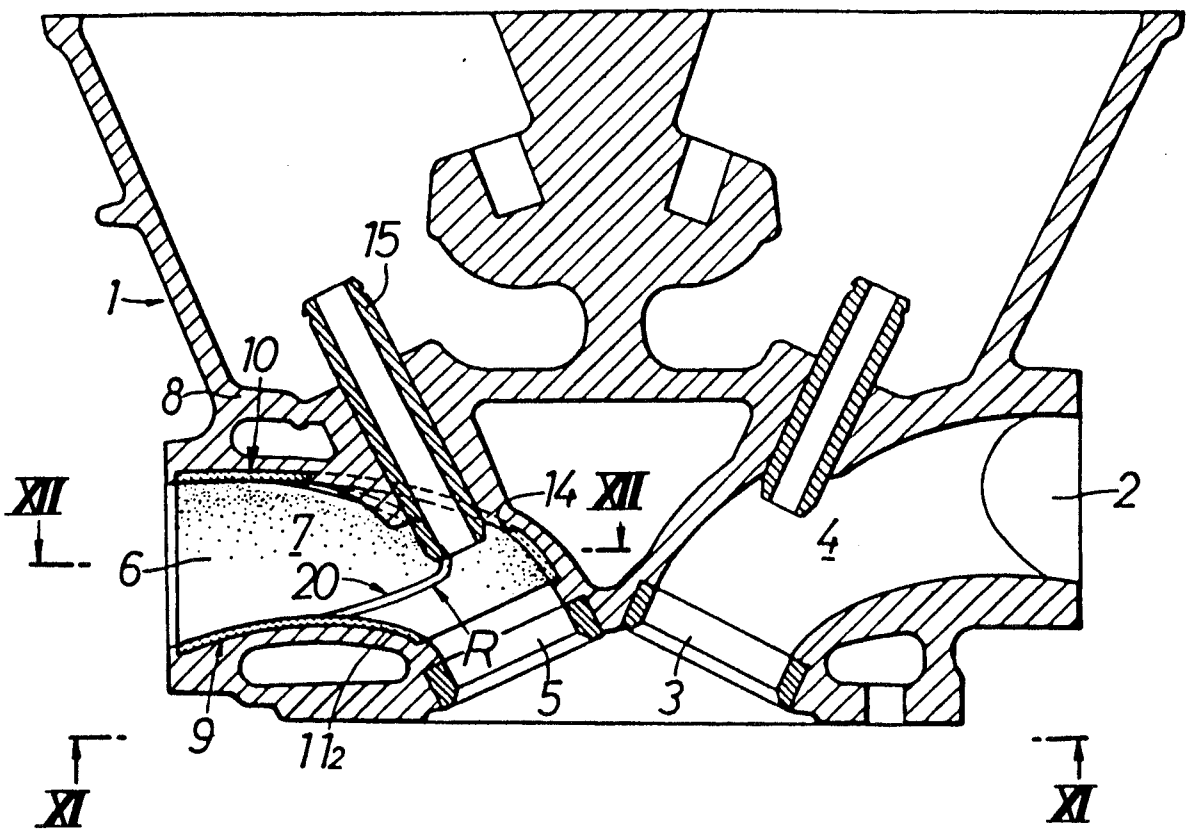
Figure 11:
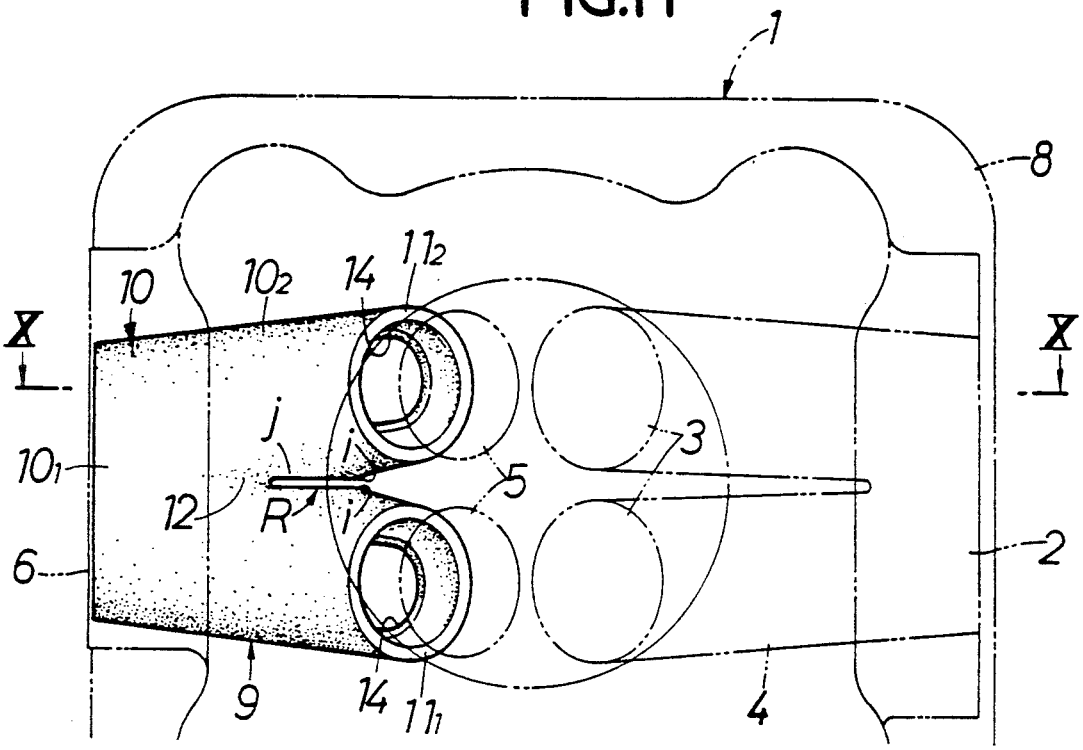
Figure 12:
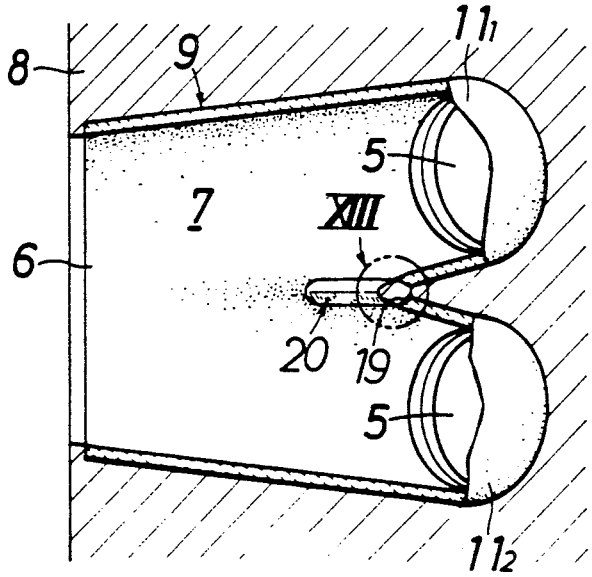
Figure 13:
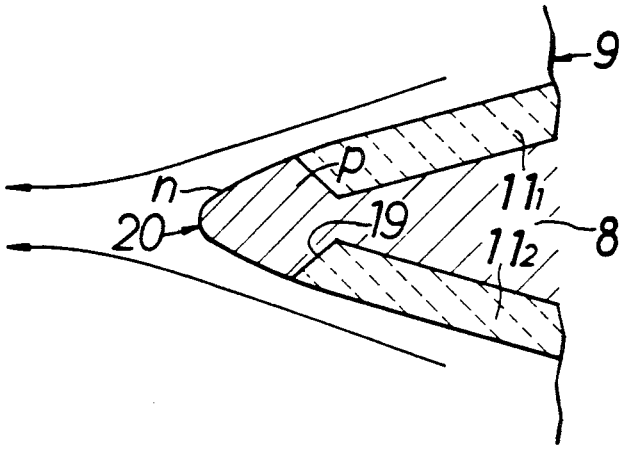
Figure 14:
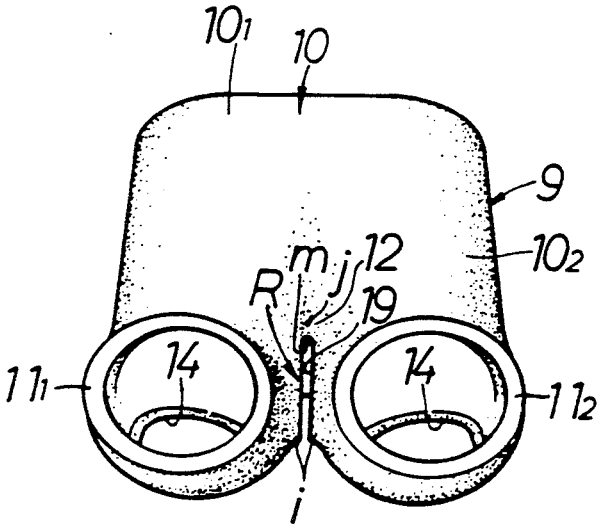
Figure 15:
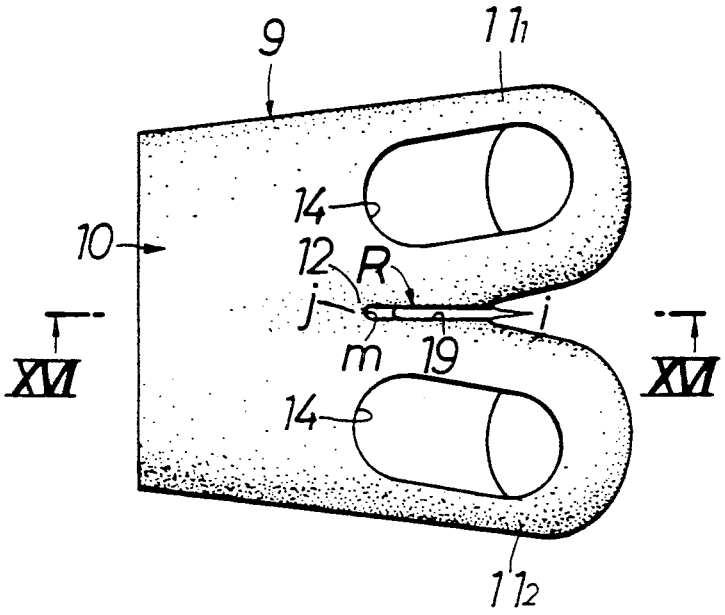
Figure 16:
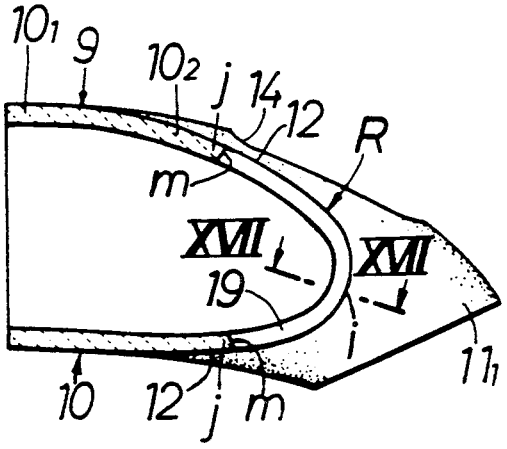

FIG. 8 shows an embodiment wherein an elongated through hole or slit 17 is provided as a through portion at the branched area R of the ceramic liner 9 and FIG. 9 shows an embodiment wherein a circular through hole 18 is provided as a through portion at the branched area R of the ceramic liner and in this illustrated embodiment at the branched wall a. These through holes 17 and 18 may be provided on at least one of the opposed peripheral wall portions b of the cylinder members $11_1$, $11_2$.

Incidentally, engine parts to which the afore-mentioned embodiments are applied may include exhaust manifolds. In this case, an exhaust manifold may comprise a manifold body made by casting and a manifold-shaped ceramic liner which is cast within the body.

FIGS. 10–19 show a second group of embodiments.

In these embodiments, a cylinder head 1 for an engine as an engine part has the same construction as of the first group of embodiments and hence identical parts are indicated by identical reference numerals and characters and their detailed description will be omitted here.

In FIGS. 11–17, the ceramic liner 9 is formed of alumina-titanate ($Al_2O_3.TiO_2$) just like the first group of embodiments and includes the hollow cylindrical liner body 10 and the pair of first and second cylinder members $11_1$ and $11_2$ which are branched from the liner body 10.

An elongated hole or slit 19 is formed as a through portion continuously over the branched area R of the ceramic liner 9 at which mutually adjacent first and second cylinder members $11_1$ and $11_2$ are branched, and more specifically in the illustration over an area from base ends i of the cylinder members $11_1$, $11_2$ to both of opposed portions j of the peripheral walls of the recess portions 12 in the second cylindrical part $10_2$, for providing communication between inside and outside of the ceramic liner 9.

Figure 17:
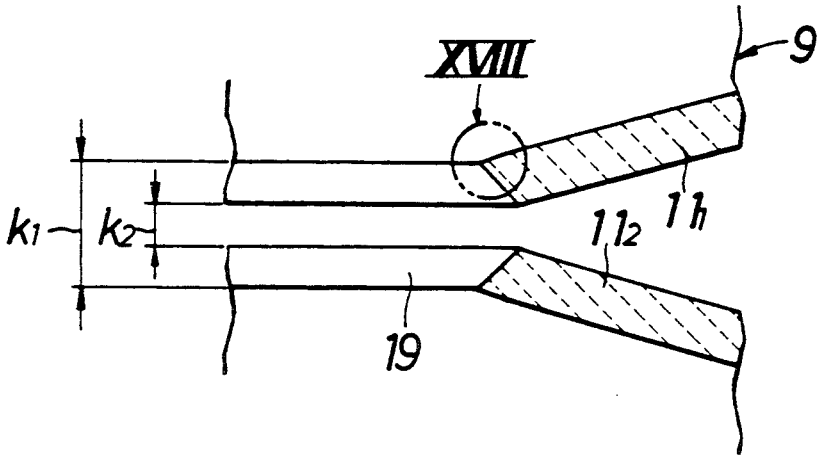

As is clearly shown in FIG. 17, the elongated hole 19 is designed so as to have a width $k_1$ of an opening on the inner side of the ceramic liner 9 (for example, 9–11 mm) which is set larger than a width $k_2$ of an opening located on the outer side of the ceramic liner 9 (for example, 3–5 mm), whereby the elongated hole 19 has a dovetail groove-shaped cross section. Also as is apparent from FIGS. 4 and 5, each of longitudinal opposite ends of the elongated hole 19 is formed to have an inside surface m of arcuate shape.

Figure 18:
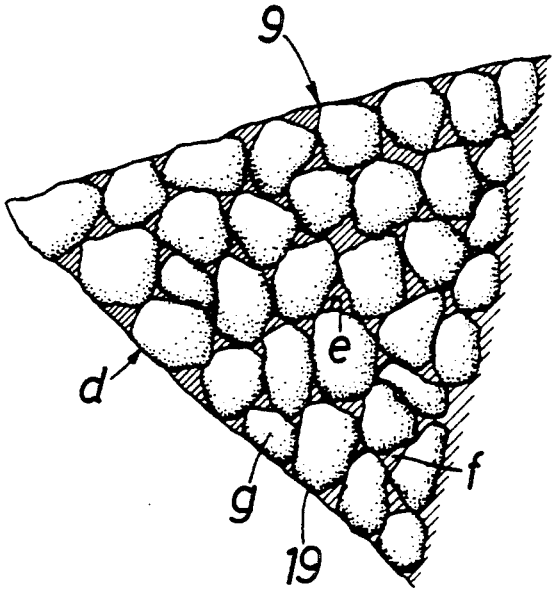

Furthermore, FIG. 18 clearly shows that glass f of the same material as that of the first group of embodiments has been filled in the same manner into the minute spaces e such as holes and cracks present in an inner wall d defining the elongated hole 19.

Like the first group of embodiments, at the time of casting the cylinder head body 8, the ceramic liner 9 is cast into the body 8. In the process of such casting, the molten metal is poured into the elongated slit 19 as well as into a guide portion shaping cavity which is defined in a core member, not shown, located within the ceramic liner 9, as clearly shown in FIGS. 12 and 13 so that a guide portion 20 integral with the cylinder head body 8 is formed so as to project inside of the ceramic liner 9 through the elongated hole 19. The guide portion 20 has a V-shaped inclined surface n which lies on an extension of the inner side surface of each of the cylinder members $11_1$, $11_2$ Heat insulating action obtained by the molten metal charged into the elongated hole 19 works to improve the flowing property of the melt around the branched area R of the ceramic liner 9 thereby enhancing the adherence between the cylinder head body 8 and the ceramic liner 9. Owing to the above-described arrangement, the guide portion 20 formed on the cylinder head body 8 serves as a heat transfer passage during engine operation and permits heat around the branched area R to be released to the cylinder head body 8 through the passage and moreover the exhaust gas of a high temperature which has passed both the cylinder members $11_1$ and $11_2$ is guided smoothly toward the liner body 10 as shown by arrows in FIG. 13. Accordingly, the branched area R is prevented from excessively heating and concentration of thermal stress on that area is moderated. Thereby, cracks are prevented from occurring at the branched area R.

Furthermore, since the guide portion 20 is formed to have a dovetail groove cross section at a portion p thereof opposed to the elongated hole 19, the guide portion 20 exhibits an anchoring effect to keep the adhesive properties between the cylinder head body 8 and the ceramic liner 9 at a good level.

In addition, any slides may occur during engine operation between the elongated hole 19 and the guide portion 20 due to differences in coefficients of thermal expansion and thermal shrinkage between aluminum alloy and ceramic material. However, since the inner wall d of the elongated hole 19 has been reinforced by glass f filled into the spaces e present in the wall d, such slides cannot cause any damages to the inner wall d as reinforced.

Moreover, due to formation of the inside surfaces m at the opposite ends of the elongated hole 19 as arcuate surfaces, it becomes possible to moderate concentration of thermal stress on the opposite ends of the hole.

Figure 19:
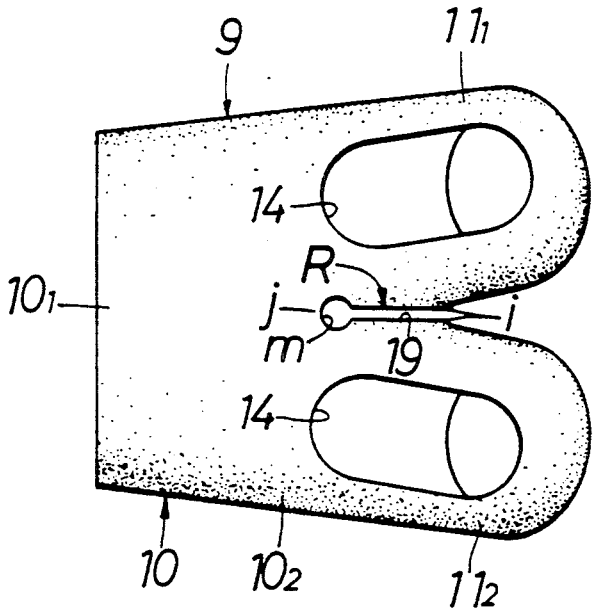
Figure 20:
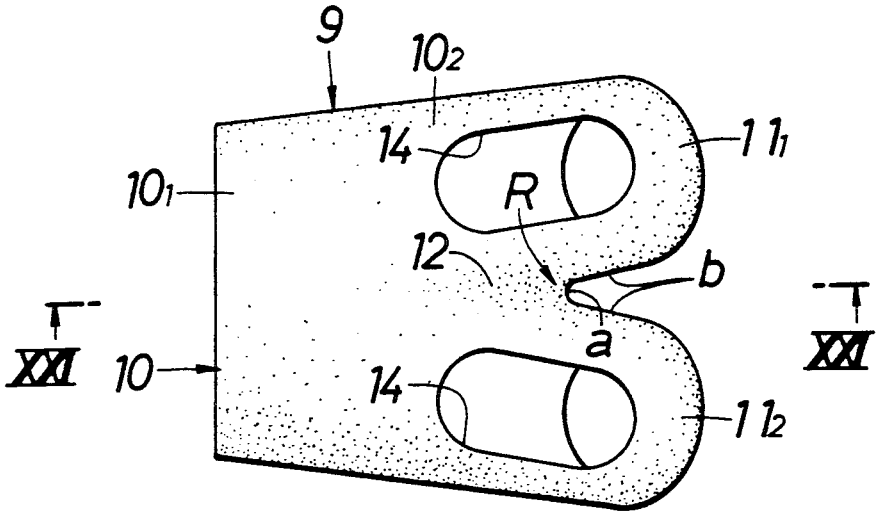
Figure 21:
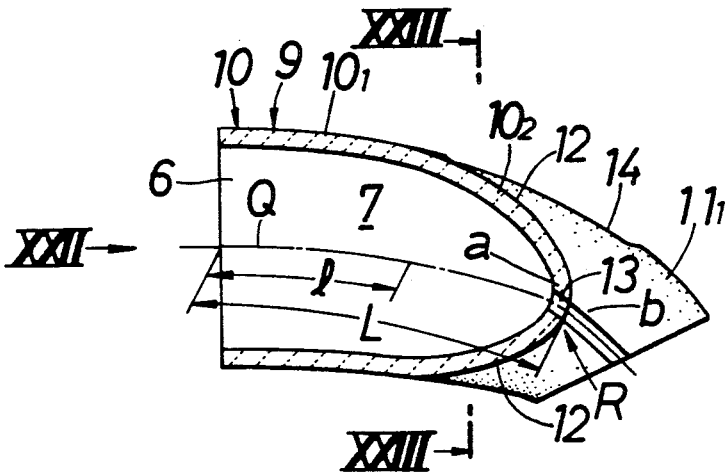
Figure 22:
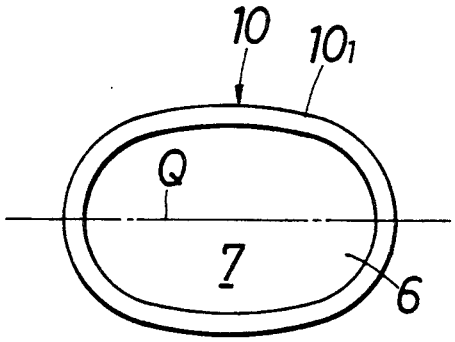
Figure 23:
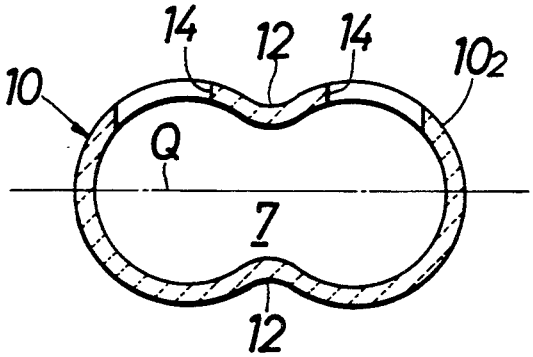

FIG. 19 shows an embodiment wherein the inside surface m at each of longitudinal opposite ends of the elongated hole 19 is formed into an arcuate surface of a notched circle so as to moderate concentration of thermal stress.

Engine parts according to these embodiments may include exhaust manifolds like the first group of embodiments.

FIGS. 20–23 show a further modified form of the ceramic liner 9 though the ceramic liner 9 is made of alumina-titanate like the foregoing embodiments.

The ceramic liner 9 has substantially the same construction as those of the first group of embodiments, however, differs therefrom in the configuration of the hollow cylindrical liner body 10.

That is, the hollow cylindrical liner body 10 according to this modified form comprises a first cylindrical part $10_1$ having an outlet 6 for the exhaust passage 7 defined therein and a second cylindrical part $10_2$ located between the first cylindrical part $10_1$ and first and second cylinder members $11_1$, $11_2$. The first cylindrical part $10_1$ has an elliptical-shaped cross section. The second cylindrical part $10_2$ has a pair of recess portions 12 which extend from the central portions of those walls of the first cylindrical part $10_1$ as opposed to each other with the long diameter of the elliptical section being interposed therebetween and which increase their depth gradually toward the branched wall a between the cylinder members $11_1$, $11_2$.

Assuming that L denote the length of the liner body 10 at its portion including the long diameter of the first cylindrical part $10_1$ and lying on a dividing plane Q which divides the ceramic liner 9 substantially into two equal parts along the exhaust passage 7 and l denote the length of the first cylindrical part $10_1$, the ratio between both the lengths l/L is set as follows:

$$0.8 \geqq l/L \geqq 0.25$$

Ceramic liners 9 of the type according to the example of FIGS. 20–23 have been formed of alumina-titanate of respective different solid state properties and they have been cast in cylinder head bodies 8 to produce cylinder heads 1, respectively.

The following table shows comparison between the solid state properties of respective alumina-titanates A to F and the results of casting.

Here, the length L of the liner body 10 has been set to 55 mm, the length l of the first cylindrical part $10_1$ has been set to 38 mm, and hence the ratio l/L of both the lengths has been set to 0.69.

Also in the table, the term "good" means that the ceramic liner 9 had no cracks generated therein and the term "bad" means that cracks have been found in the branched wall a.

| | Alumina-titanate | | | | | |
|---|---|---|---|---|---|---|
| | A | B | C | D | E | F |
| Young's modulus E ($kg/mm^2$) | 3,000 | 2,500 | 1,800 | 300 | 300 | 100 |
| Strength against breakage $\sigma_5$ | 4.0 | 3.5 | 2.5 | 0.9 | 0.6 | 0.5 |
| $\sigma_5/E$ ($\times 10^{-3}$) | 1.3 | 1.4 | 1.4 | 3.0 | 2.0 | 5.0 |
| Results of comparison | good | bad | bad | good | good | good |

The following may be commented from this table. Namely, in case of alumina-titanate A having a high Young's modulus E of 3,000 $kg/mm^2$ or so, the strength against breakage of $\sigma_B \geqq 3.7$ $kg/mm^2$ can be used as the standard for selecting the material whereas in case of alumina-titanates D to F having a low Young's modulus E not more than 300 $kg/mm^2$, the standard for material selection can be set to the strength against breakage-/Young's modulus $\geqq$ 1.8.

It is considered that a ceramic liner formed of alumina-titanate A is of a relatively high strength and therefore is free of generation of cracks which may otherwise be generated by the solidification shrinkage force at the time of casting the cylinder head body 8 and that in case of ceramic liners made of alumina-titanates D to F, their strengths are relatively low and they can absorb the solidification shrinakge force during casting of the cylinder head body 8 and therefore they can be free of cracks.

Incidentally, the configuration of the liner bodies 10 of the ceramic liners 9 in the first and second groups of embodiments may be identical to that of the example of FIGS. 20–23.

Figure 24:
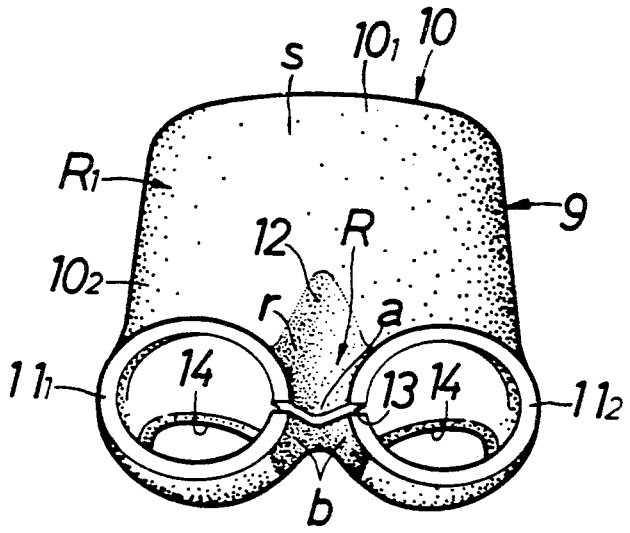
Figure 25:
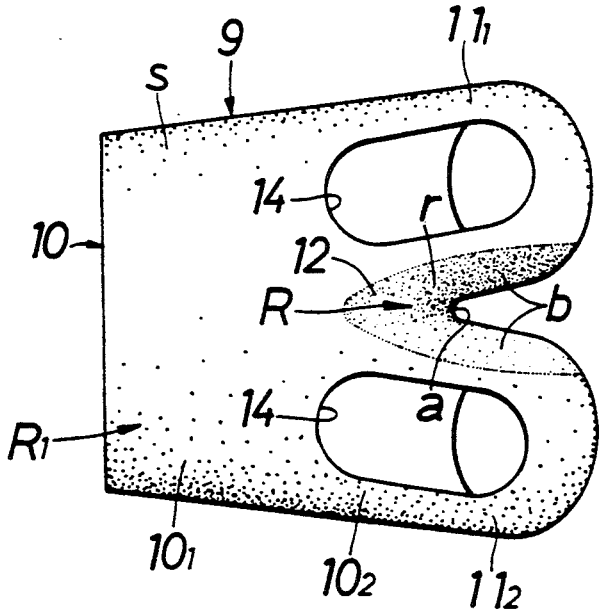

FIGS. 24 and 25 show a further modified form of the ceramic liner 9. This ceramic liner 9 is substantially of the same configuration as of FIGS. 20–23.

When it is required to avoid a stress concentration on the branched area R of the ceramic liner 9 at the time of casting the cylinder head body 8, the outside surface of the area R should preferably be as smooth as possible whereas the outside surface of a remaining area $R_1$ other than the branched area $R_1$ should be rough to an appropriate extent in order to achieve a good adherence between the area $R_1$ and the cylinder head body 8.

From these points of view, the surface roughness Rmax of the outside surface r at the branched area R of the ceramic liner 9 and in the illustration at the area including the branched wall a of the liner body 10 and its adjacent portion (inclusive of a part of the recess portions 12) and further including the opposed portions b of the peripheral walls of the cylinder members $\mathbf{11}_1$ and $\mathbf{11}_2$ is set at less than 30 μm while the surface roughness Rmax of the outside surface s at the remaining area $R_1$ other than the branched area R is set at not less than 30 μm but below 100 μm.

Figure 26:
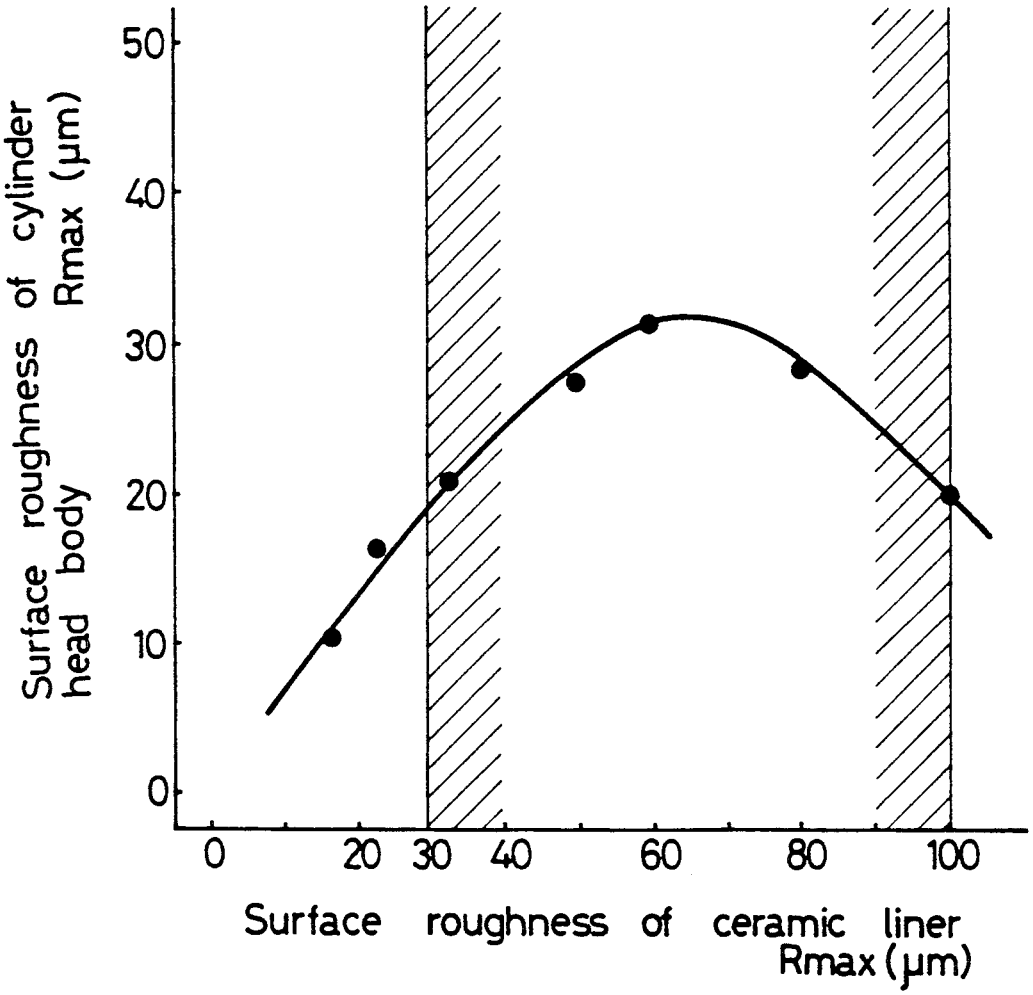
FIG. 26 is a graph showing a relationship between the surface roughness of ceramic liner and that of cylinder head body.

FIG. 26 shows a relationship between the surface roughness of the outside surface s at the remaining area $R_1$ of the ceramic liner 9 and the surface roughness of the cylinder head body 8 which is established under application of the low pressure casting method.

In this figure, if the surface roughness Rmax of the remaining area $R_1$ is set at not less than 30 μm, the depth of penetration of the molten metal into minute recess portions on the outside surface s of the remaining area $R_1$ increases even under application of the low pressure casting method to make the surface roughness Rmax of the cylinder head body 8 not less than about 20 μm, thereby strengthening the adhesion of the cylinder head body 8 with respect to the ceramic liner 9. On the other hand, if the surface roughness Rmax of the outside surface s of the remaining area $R_1$ exceeds 100 μm, gas generated at the time of casting operation stays within the minute recess portions on the outside surface s of the area $R_1$ thereby to lower the surface roughness of the cylinder head body 8 to a level below 20 μm and as a result the adhesion of the cylinder head body 8 to the ceramic liner 9 is reduced.

This relationship in surface roughness will be the same under application of a gravity die casting method. However, when a high pressure casting method is applied, a high pressure acting on a molten metal enables the molten metal to be filled into the minute recess portions on the outside surface of the ceramic liner 9 sufficiently so that the surface roughness of the ceramic liner 9 can be disregarded.

Figure 27:
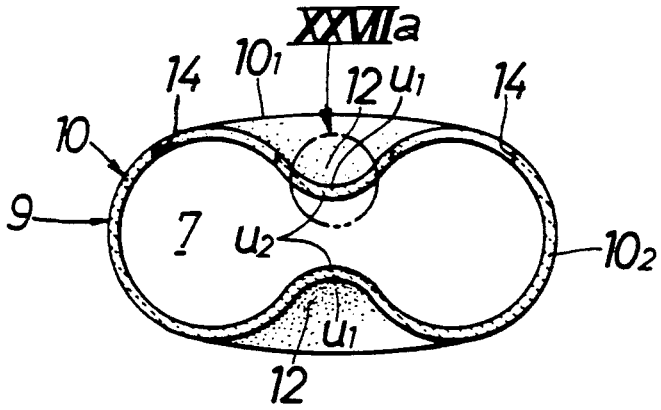
Figure 27A:
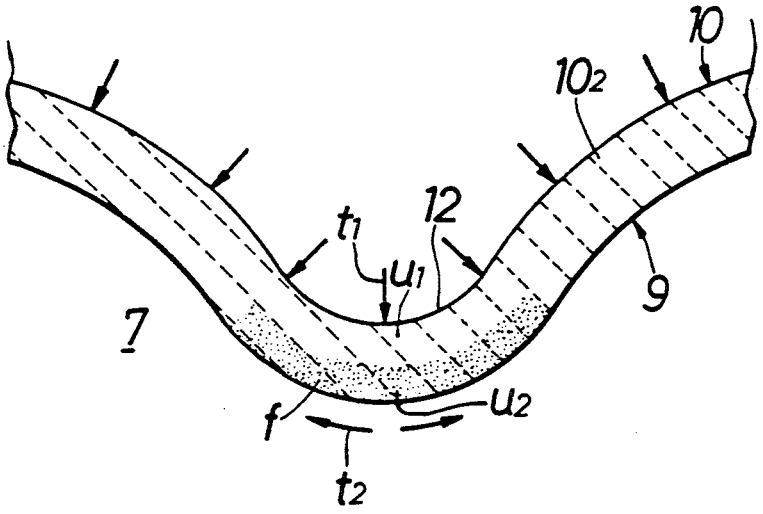

FIGS. 27 and 27A show a further modified form of the ceramic liner 9. This ceramic liner is substantially identical to that of FIGS. 20–23 in configuration.

When the ceramic liner 9 is cast within the cylinder head body 8, a compression stress $t_1$ acts on an outer wall side $u_1$ of each of the recess portions 12 by the molten metal pressure and the solidification and shrinkage of the cylinder head body 8 as shown in FIG. 27A and this in turn causes a tensile stress $t_2$ to be exerted on an inner wall side $u_2$ of each recess portion 12.

The tensile stress $t_2$ thus produced may become a cause for generating cracks at the inner wall side $u_2$ of each recess portion 12 and hence, it is required to construct the inner wall side $u_2$ to have a high strength.

To meet this requirement, glass f of the same kind as of the afore-mentioned ones is filled into minute spaces such as holes and cracks present in the inner wall side $u_2$ of each recess portion 12 in the same manner.

Owing to this arrangement, the inner wall sides $u_2$ of both recess portions 12 which require a high strength are formed to have a high density through the production process of the ceramic liner 9 and are reliably reinforced. It will of course be apparent that glass may also be filled into other portions requiring a strength such as the outer wall sides $u_1$ of the recess portions 12, the branched wall a and the like or into the whole of the ceramic liner 9.

As other reinforcing means for portions which require a strength (or the whole ceramic liner 9), there may be listed up such measures to form those portions to have a fine structure and/or to have metallic oxides dispersed at grain boundaries.

When obtaining a ceramic liner 9 of such a structure as mentioned above, particles of alumina-titanate are used to shape a ceramic molded article as a ceramic blank material corresponding to the ceramic liner 9, then a solution including at least one kind of metallic oxide to be dispersed in alumina-titanate which is selected from the group consisting of $SiO_2$, $ZrO_2$, MgO, $Fe_2O_3$ and $SnO_2$ is coated and impregnated into spaces present in predetermined portion(s) of the ceramic molded article and thereafter the article is subjected to a sintering treatment which serves also as a diffusion treatment.

The content of each metallic oxide such as $SiO_2$ in the ceramic liner 9 is appropriately in a range of 0.05 to 5 weight %. It is effective in respect of reinforcement to mix the metallic oxides with alumina-titanate and a small amount of CaO in the form of elements included in the aforementioned solution. When alumina-titanate is added to the solution, the solution may become slurry.

The measure proposed above causes $SiO_2$ and the like to be diffused in alumina-titanate and predetermined portions of the liner 9 to have a fine structure and thereby metallic oxides are dispersed at the grain boundaries.

As other reinforcement means, there may be listed up a measure to provide a fine structure at the predetermined portions and/or to diffuse metallic oxides at grain boundaries and to provide a composite of whisker w (diffusion at the grain boundaries).

When a ceramic liner 9 of the just-mentioned structure is to be achieved, particles of alumina-titanate and silicon carbide whisker as said whisker are employed for shaping a ceramic molded article which corresponds to the ceramic liner 9 and then a solution including said metallic oxides diffused in alumina-titanate is applied to and impregnated in the spaces present in the predetermined portions of the ceramic molded article. Thereafter, the ceramic molded article is subjected to a diffusion treatment which serves also as a sintering treatment.

The content of silicon carbide whisker in the ceramic liner 9 is appropriately in a range of 0.05 to 5 weight %. The content of each metallic oxide likewise stays appropriately in a range of 0.05 to 5 weight %. Moreover, similarly to the afore-mentioned case, alumina-titanate and a small amount of CaO may be added to the metallic oxides as elements to be included in the solution when desired.

This proposed measure causes $SiO_2$ and the like to be diffused in alumina-titanate, said predetermined portions to have a fine structure, the metallic oxides to be dispersed at the grain boundaries and silicon carbide whisker to become composite.

Figure 28:
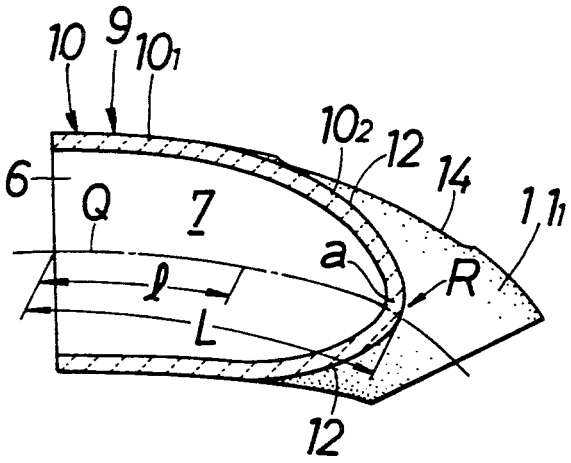
FIG. 28 is a sectional view of a still further modified form of ceramic liner, corresponding to FIG. 21.

FIG. 28 shows a further modified form of the ceramic liner 9. This ceramic liner 9 is substantially identical to that of FIGS. 20–23 in its configuration and therefore the ratio of two lengths l/L is set to $0.8 \geqq l/L \geqq 0.25$. However, it has no slit 13. It is formed of alumina-titanate.

What is claimed is:

1. An engine part provided with a manifold type exhaust passage, comprising a cast main body and a manifold type ceramic liner which is cast in the main body and defines a manifold type exhaust passage, the ceramic liner including a hollow cylindrical liner body and a plurality of cylinder members branched from said liner body, wherein a through portion is provided at a branched area of said ceramic liner for providing communication between inside and outside of the ceramic liner at which area adjacent cylinder members are branched apart, said through portion being filled with a molten metal at the time of casting said main body.

2. An engine part as set forth in claim 1, wherein the through portion has an opening located on an inner surface side of the ceramic liner which is set larger than an opening thereof on an outer surface side of the ceramic liner.

3. An engine part as set forth in claim 1 or 2, wherein glass is filled in spaces which are present in an inner wall of the through portion.

4. An engine part as set forth in claim 1 or 2 wherein the through portion is a slit which extends continuously over a branched wall of the liner body and opposed portions of peripheral walls of the adjacent cylinder members.

5. An engine part as set forth in claim 1 or 2 wherein the through portion is a through hole.

6. An engine part as set forth in claim 1 or 2, wherein the cast main body is integrally formed with a guide portion which projects inside of the ceramic liner through the through portion and serves to guide an exhaust gas which has passed the adjacent cylinder members toward the liner body.

7. An engine part provided with a manifold type exhaust passage, comprising a cast main body and a bifurcated ceramic liner which is cast in the main body and defines a bifurcated exhaust passage, the ceramic liner including a hollow cylindrical liner body and a pair of cylinder members branched from the liner body, wherein a through portion is provided at a branched area of said ceramic liner for providing communication between inside and outside of the ceramic liner at which area the cylinder members are branched apart, said through portion being filled with a molten metal at the time of casting said main body, and wherein said hollow cylindrical liner body includes a cylindrical part of an elliptical cross section having an outlet for the exhaust passage, a ratio between a length (L) of the liner body measured on a dividing plane which includes a long diameter of the elliptical cylindrical part and divides the ceramic liner substantially into two equal parts along the exhaust passage and a length (l) of the cylindrical part being set as follows:

$$0.8 \geqq l/L \geqq 0.25$$

8. An engine part as set forth in claim 1, 2 or 7, wherein the ceramic liner is formed of alumina-titanate.

9. An engine part provided with a manifold type exhaust passage, comprising a cast main body and a bifurcated ceramic liner which is cast in the main body and defines a bifurcated exhaust passage, the ceramic liner including a hollow cylindrical liner body and a pair of cylinder members branched from the liner body, wherein the ceramic liner is formed of alumina-titanate and wherein said hollow cylindrical liner body includes a cylindrical part of an elliptical cross section having an outlet for the exhaust passage, a ratio between a length (L) of the liner body measured on a dividing plane which includes a long diameter of the elliptical cylindrical part and divides the ceramic liner substantially into two equal parts along the exhaust passage and a length (l) of the cylindrical part being set as follows:

$$0.8 \geqq l/L \geqq 0.25$$

10. An engine part as set forth in claim 3, wherein the through portion is a slit which extends continuously over a branched wall of the liner body and opposed portions of peripheral walls of the adjacent cylinder members.

11. An engine part as set forth in claim 3, wherein the through portion is a through hole.

12. An engine part as set forth in claim 3, wherein the cast main body is integrally formed with a guide portion which projects inside of the ceramic liner through the through portion and serves to guide an exhaust gas which has passed the adjacent cylinder members toward the liner body.

13. An engine part as set forth in claim 3, wherein the ceramic liner is formed of alumina-titanate.

14. An engine part as set forth in claim 4, wherein the cast main body is integrally formed with a guide portion which projects inside of the ceramic liner through the through portion and serves to guide an exhaust gas which has passed the adjacent cylinder members toward the liner body.

15. An engine part as set forth in claim 4, wherein the ceramic liner is formed of alumina-titanate.

16. An engine part as set forth in claim 5, wherein the cast main body is integrally formed with a guide portion which projects inside of the ceramic liner through the through portion and serves to guide an exhaust gas which has passed the adjacent cylinder members toward the liner body.

17. An engine part as set forth in claim 5, wherein the ceramic liner is formed of alumina-titanate.

18. An engine part as set forth in claim 6, wherein the ceramic liner is formed of alumina-titanate.

* * * * *